US005998746A

United States Patent [19]

Clark

[11] Patent Number: 5,998,746

[45] Date of Patent: Dec. 7, 1999

[54] SELF-ADJUSTING DOOR-AJAR SWITCH

[75] Inventor: Teresa D. Clark, High Ridge, Mo.

[73] Assignee: Chrysler Corporation, Auburn Hills, Mich.

[21] Appl. No.: 09/069,413

[22] Filed: Apr. 29, 1998

[51] Int. Cl.[6] ..... H01H 1/34

[52] U.S. Cl. ..... 200/286

[58] Field of Search ..... 200/61.62, 61.69, 200/61.7–61.74, 61.81, 293–296, 261.2, 261.83

[56] References Cited

U.S. PATENT DOCUMENTS

| | | | |
|---|---|---|---|
| 3,787,650 | 1/1974 | Lewis | 200/61.04 |
| 4,001,531 | 1/1977 | Crockett, Sr. | 200/61.04 |

*Primary Examiner*—Michael L. Gellner
*Assistant Examiner*—Nhung Nguyen
*Attorney, Agent, or Firm*—Lawerence Shurupoff

[57] ABSTRACT

A door-ajar switch assembly for a door movable between open and closed positions relative to an opening in a vehicle body. The switch includes a housing supported adjacent to the opening in a position of inward and outward adjustment. An actuator projects outwardly from the housing and is retractable inwardly to a switch-actuating position. A switch operator is mounted on the door and moves the switch-actuator to the switch-actuating position when the door is closed. The switch operator has an actuator-engaging front face. An adjustment member is secured to the front face of the operator to engage the actuator when the door is initially closed to retract the actuator beyond the switch-actuating position and push the housing inwardly to an adjusted position. The adjustment member is made of a water-soluble material and dissolves away when subjected to water treatment, leaving the front face of the operator to engage and to retract the actuator to its switch-actuating position when the door is subsequently closed.

11 Claims, 2 Drawing Sheets

SELF-ADJUSTING DOOR-AJAR SWITCH

This invention relates to switches and more particularly to a self-adjusting door-ajar switch.

BACKGROUND AND SUMMARY OF THE INVENTION

Many motor vehicles have a warning lightbulb on the dash board which lights up when a door is open or ajar. When the door is closed the light goes off. A switch is provided on a pillar of the vehicle body to control the operation of the lightbulb. A button-like operator on the door engages a switch plunger when the door is closed, opening the circuit to the lightbulb. When the door is open, the switch plunger is released and extended, closing the circuit to the lightbulb.

One problem in the manufacture of automotive vehicles is the proper setting of the switch. Typically, the switch will have a housing in which the switch plunger is slidably supported. A casing mounts the housing on a pillar in an adjusted position such that the plunger extends out exactly the right distance to open the circuit to the lightbulb only when the door is fully closed. In the past, a special tool has been provided to make the adjustment. The tool is mounted on the door in place of the switch operator. When the door is closed, the tool projects further from the door than the operator and will not only retract the switch plunger, but will press the switch housing into the pillar to an adjusted position. With the switch housing thus adjusted, the tool is replaced by the usual button-like operator which will operate the switch when the door is closed.

This method of setting the switch performs satisfactorily, but occasionally a worker will fail to use the tool, in which event the switch will not be set properly and no indication of this failure is readily visible.

The present invention dispenses with the need for a separate tool. Instead, a disc of a water-soluble material, preferably polyvinyl-alcohol, is applied to the head of the operator. The operator-disc combination serves the function of a tool to properly set the switch in adjusted position. Thereafter, the disc is sprayed or flushed with water which washes away the polyvinyl-alcohol disc. The disc thus "disappears" leaving only the operator which thereafter serves its usual function of operating the lightbulb switch.

One object of this invention is to provide a means for adjusting a door-ajar switch having the foregoing features and capabilities.

Another object is to provide a means for adjusting a door-ajar switch which is of simple construction, can be readily and inexpensively manufactured, and is easy to operate.

These and other objects, features and advantages of the invention will become more apparent as the following description proceeds, especially when considered with the accompanying drawings.

DETAILED DESCRIPTION OF THE PREFERRED EMBODIMENT

Figure 1:
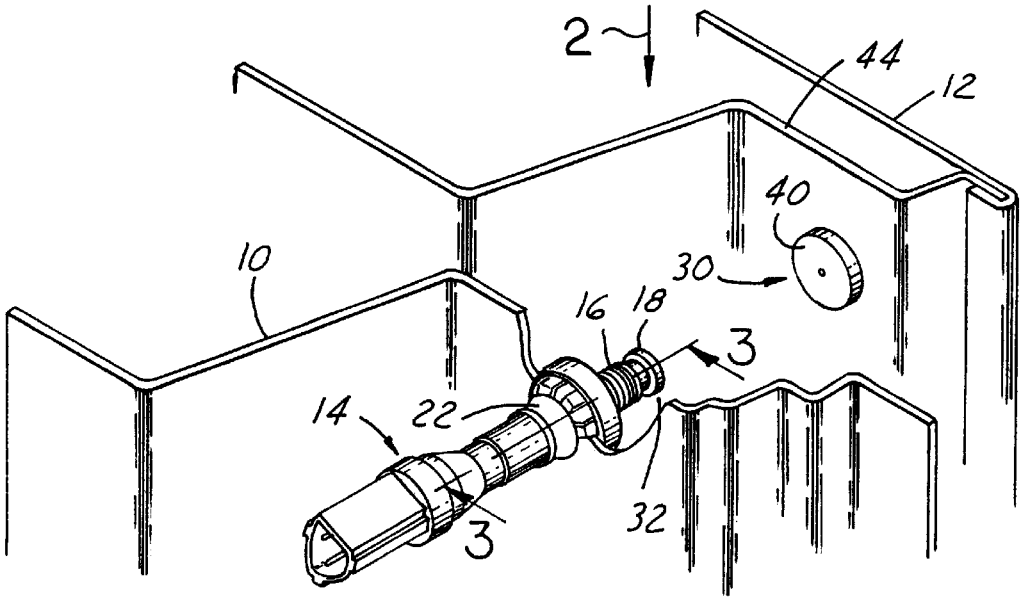
FIG. 1 is a fragmentary sectional perspective view showing a door in open position relative to a vehicle pillar, with a switch mounted on the pillar and a switch operator mounted on the door.
Figure 2:
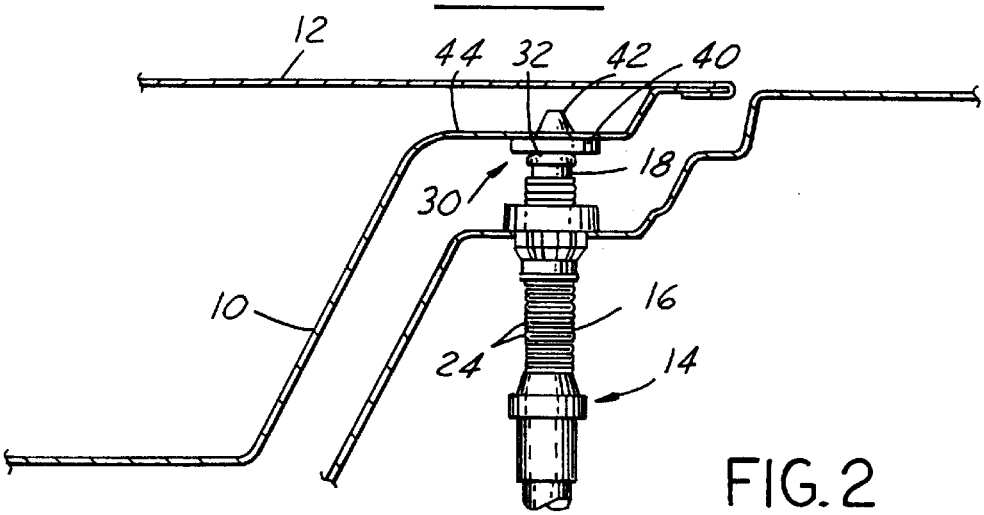
FIG. 2 is a view taken in the direction of the arrow 2 in FIG. 1 but with the door closed.

Referring now more particularly to the drawings, and especially FIGS. 1 and 2, there is shown a vehicle body pillar 10 forming part of fixed, rigid, vehicle support structure, and a closure 12 for controlling an opening to the vehicle body. The closure 12 is a movable member and is movable toward and away from the pillar to close and open the opening. The closure may, for example, be a sliding door or a hinged door or a hinged hatch of the type employed at the rear of a minivan.

Figure 3:
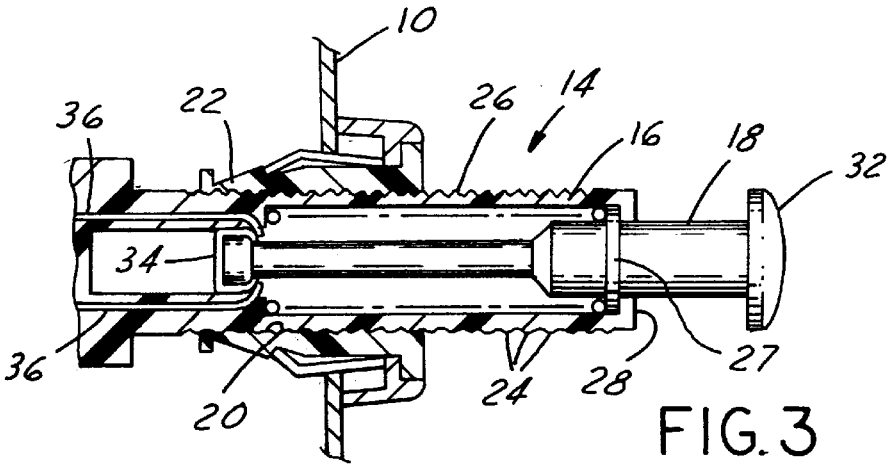
FIG. 3 is a fragmentary sectional view of the switch, taken on the line 3—3 in FIG. 1.

A switch 14 (FIGS. 1–3) is mounted on the pillar 10. The switch includes a switch housing 16 and a switch actuator in the form of a plunger 18 in the housing. The switch housing 16 is an elongated tubular member received and frictionally held in a cylindrical channel or bore 20 in a tubular casing 22. The casing is rigidly secured to the pillar 10.

The switch housing 16 has a cylindrical outer surface formed with axially spaced radially outwardly projecting circular ribs 24. The ribs are slightly larger in diameter than the bore 20 in the casing. The housing 16 is preferably made of a somewhat compressible material such as a suitable plastic so that the ribs 24 will compress slightly when the housing is forced into the bore, and have a firm frictional engagement with the wall of the bore. The casing may, if desired, be made of the same material as the housing. The purpose of the somewhat interfering engagement of the ribbed housing 16 in the bore 20 is to retain the housing in an axially adjusted position but to enable the housing to be adjusted by axial pressure exerted thereon.

The switch plunger 18 is an elongated member axially slidable lengthwise within the tubular housing 16. A spring 26 in the housing presses the plunger 18 to an outer limiting position, but the plunger may be pushed inwardly from its outer limiting position against the pressure of spring 26. The plunger 18 is in its outer limiting position when the closure 12 is open. A collar 27 on the plunger engages a flange 28 on the housing to establish the outer limit of movement of the plunger 18. The plunger, when in its outer limiting position, closes a circuit to a lightbulb on the instrument panel to illuminate the lightbulb and thereby indicate that the closure is open or ajar. When the closure is closed, an operator 30 on the closure engages the head 32 of the plunger 18, pressing the plunger inwardly from its outer limiting position to open the circuit to the lightbulb. The circuit is closed by a contact 34 on the inner end of the plunger engaging circuit contacts 36 in the housing. The lightbulb and circuit from the switch to the lightbulb are conventional and well known in the art and do not require illustration or further description. The switch 14 and operator 30 together provide a door-ajar switch assembly.

Figure 5:
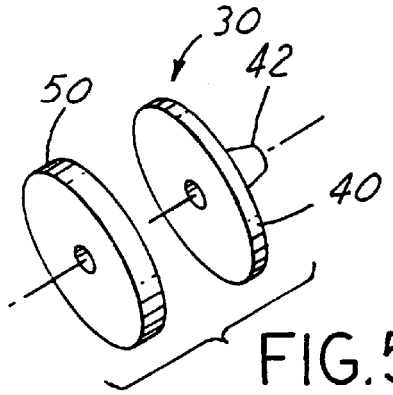
FIG. 5 is an exploded perspective view of the switch operator and adjustment disc.

The operator 30 (FIGS. 4 and 5) is in the form of a flat, circular, disc or button or plug 40 of rubber or similar resilient material, having an integral retainer 42 on the back received in a hole in the inner panel 44 of the closure 12. The retainer 42 is cone-shaped to enable it to enter the hole and is undercut at 43 along the base to frictionally retain the operator attached to the inner panel 44 of the closure.

An adjustment member in the form of a flat, circular disc 50 (FIG. 5) of the same diameter as the button 40, is secured as by a suitable adhesive to the front face of the button 40 which serves as a resilient mounting member for the disc 50. The adjustment disc is made of a water-soluble material, preferably polyvinyl alcohol. The adjustment disc 50 is for the purpose of initially adjusting the position of the switch as will now be described.

Figure 4:
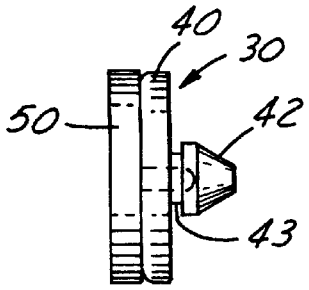
FIG. 4 is a side elevational view showing an adjustment disc secured to the switch operator in accordance with this invention.
Figure 6A:
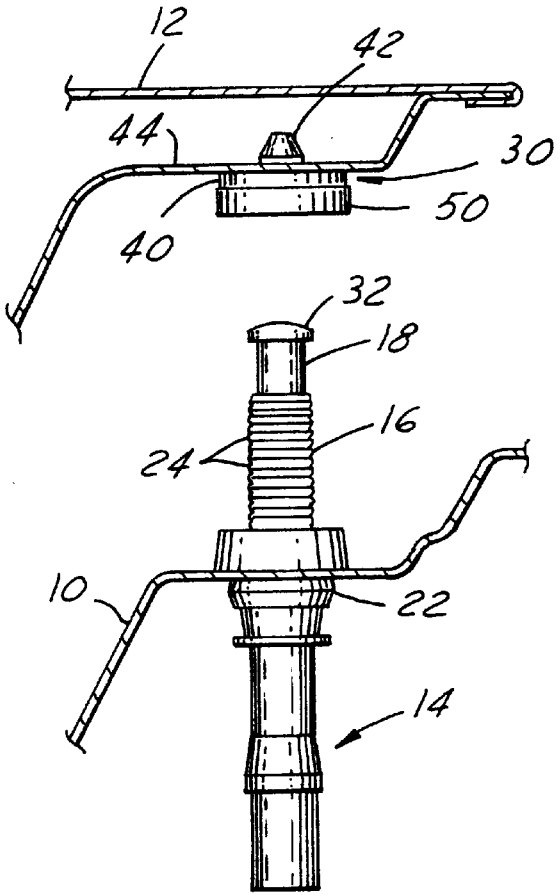
FIG. 6A is a view similar to FIG. 2 but with the adjustment disc attached to the switch operator and the door in an open position.
Figure 6B:
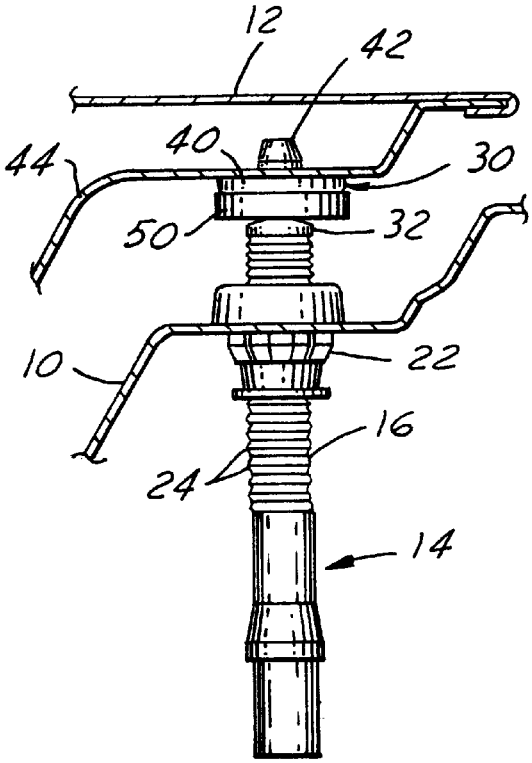
FIG. 6B is similar to 6A but with the door closed.

The switch 14 is usually installed at the factory during manufacture of the vehicle. At that time, the operator 30 will have the adjustment disc 50 secured to it as shown in FIG. 4, and the switch 14 will assume the extended position of FIG. 6A. The adjustment disc 50 has a thickness such that when the operator 30 is installed on the inner panel 44 of the closure and the closure is closed on the pillar, the adjustment disc 50 will be moved inwardly to a position in which it will engage the switch plunger 18, fully retract the plunger into the housing 16 and actually push the housing inwardly to an axially adjusted position within the bore 20 in the casing (FIG. 6B). This process sets the switch so that the switch housing and switch plunger are properly located with respect to the door. Thereafter, the water-soluble adjustment disc 50 is flushed with water to cause it to dissolve and, in effect, wash away or disappear. This may be carried out in a special water treatment procedure or may occur in an in line water booth through which the emerging vehicle passes as part of the vehicle manufacturing process. Either way, the water-soluble disc 50 is removed from the operator 30 and henceforth and during normal operation of the vehicle the operator 30 will consist only of the button 40 without the adjustment disc 50, as in FIGS. 1 and 2. Then, when the closure is closed, the operator will engage the plunger, move it inwardly relative to the housing 16 far enough to open the circuit to the lightbulb and cause the lightbulb to go off as in FIG. 2. The housing will not be disturbed and will remain in its adjusted position.

It is well known that when a door or closure is slammed shut, it sometimes over closes and then springs back very slightly, but still retains its closed and fully latched position. The operator 30 will, however, maintain the plunger depressed far enough to keep the switch open despite this slight spring back of the door. The over travel switch provided bo the switch by the disc 50 during initial adjustment provides extra tolerance to the switch to accommodate body flexure and relative movement between the pillar and door when the door is fully latched. This prevents a false signal that the door is ajar when it is in fact fully latched.

What is claimed is:

1. A switch assembly, comprising:

a switch having an actuator;

a movable member movable in a direction toward said switch, and an operator carried by and movable with said movable member toward said switch and engageable with said actuator, said operator having a water-soluble switch adjustment member thereon, wherein said switch comprises a housing in which said actuator is slidable and wherein means are provided to support said housing for adjustment in a direction corresponding to the direction of movement of said movable member, said switch adjustment member being operable to adjust the position of said housing upon movement with said movable member toward said switch.

2. The assembly of claim 1, wherein said operator comprises a resilient mounting member mounted to said movable member and wherein said adjustment member is a disc mounted on said mounting member.

3. The assembly of claim 1, wherein said movable member comprises a door.

4. The assembly of claim 1, wherein said movable member comprises a hatch.

5. The assembly of claim 1, wherein said water-soluble member is made of polyvinyl alcohol.

6. A door-ajar switch assembly for a door movable between open and closed positions in relation to an opening in a vehicle body comprising, a switch having a housing, a casing fixed adjacent to said opening and supporting said housing in a position of inward and outward adjustment, an actuator projecting outwardly from said housing and retractable inwardly relative to said housing to a switch actuating position, a switch operator mounted on said door to move the switch actuator to the switch-actuating position when said door is moved to the closed position thereof, said switch operator having an actuator-engaging front face, and an adjustment member secured to said front face of said operator adapted to engage said actuator when said door is initially moved to the closed position to retract said actuator beyond the switch-actuating position thereof and push said housing inwardly to an adjusted set position, said adjustment member being water-soluble and dissolving away when subjected to water treatment leaving said front face of said operator to engage and to retract said actuator inwardly to its switch actuating position when said door is subsequently moved to the closed position thereof.

7. A switch assembly as in claim 6, wherein said operator comprises a first disc, and said adjustment member comprises a second disc.

8. A switch assembly as in claim 7, wherein said second disc is made of polyvinyl alcohol.

9. A switch assembly as in claim 7, wherein said discs are flat.

10. A switch assembly as in claim 9, wherein said second disc is made of polyvinyl alcohol.

11. A method of setting a door-ajar switch for a door movable between open and closed positions relative to a vehicle opening, wherein the switch has a housing adjustably mounted on fixed vehicle support structure adjacent said opening and a switch actuator projects from the housing, and wherein a switch operator mounted on said door moves toward the switch when the door is moved to closed position to engage and retract the switch actuator, and thereby operate the switch, comprising applying an adjustment member made of a water-soluble material to said operator, closing said door to cause said adjustment member to press said housing inwardly to an adjusted position, opening the door, and removing said adjusting member from said operator by water treatment sufficient to dissolve the adjustment member.

* * * * *